US009533789B2

(12) United States Patent
Selina et al.

(10) Patent No.: US 9,533,789 B2
(45) Date of Patent: Jan. 3, 2017

(54) PLASTIC CONTAINER WITH FLUTED INNER WALL

(71) Applicant: LETICA CORPORATION, Rochester Hills, MI (US)

(72) Inventors: John R. Selina, Brighton, MI (US); Christopher Myles Larsen, Farmington Hills, MI (US)

(73) Assignee: Letica Corporation, Rochester, MI (US)

( * ) Notice: Subject to any disclaimer, the term of this patent is extended or adjusted under 35 U.S.C. 154(b) by 99 days.

(21) Appl. No.: 14/162,033

(22) Filed: Jan. 23, 2014

(65) Prior Publication Data

US 2015/0203238 A1 Jul. 23, 2015

(51) Int. Cl.
*B65D 1/42* (2006.01)
*B65D 1/16* (2006.01)

(52) U.S. Cl.
CPC ..... *B65D 1/42* (2013.01); *B65D 1/165* (2013.01)

(58) Field of Classification Search
CPC ..... B65D 1/34; B65D 1/40; B65D 1/42; B65D 1/44
USPC ..... 220/272, 268, 635, 672
See application file for complete search history.

(56) References Cited

U.S. PATENT DOCUMENTS

D37,604 S 10/1905 Fletcher
D47,684 S 8/1915 Blaze
D47,721 S 8/1915 Haley
D72,639 S 10/1926 Schmidt
D73,054 S 7/1927 Schmidt
3,070,275 A 12/1960 Bostrom
3,169,688 A 2/1965 Schad
3,169,689 A 2/1965 Schwartz
D201,400 S 6/1965 Kneeland
3,194,468 A 7/1965 Baron
D295,480 S 5/1988 Pomroy
5,261,558 A * 11/1993 Claydon ..... B21D 51/2646 220/671
5,279,442 A * 1/1994 Jentzsch et al. ..... 220/671
5,305,911 A * 4/1994 Aylward ..... 220/675
5,310,073 A 5/1994 Johannsson
5,322,213 A 6/1994 Carter et al.
D380,647 S * 7/1997 Durand ..... D7/531
6,550,645 B2 4/2003 Nelson et al.
7,216,769 B2 5/2007 Palder
8,210,391 B2 * 7/2012 Luburic ..... 220/635
8,348,086 B2 * 1/2013 Apps ..... 220/592.19
8,495,854 B2 7/2013 Seidita
8,684,223 B1 * 4/2014 Kalamaras ..... A47G 19/2288 215/12.1

(Continued)

*Primary Examiner* — Anthony Stashick
*Assistant Examiner* — Raven Collins
(74) *Attorney, Agent, or Firm* — Young Basile Hanlon & MacFarlane, P.C.

(57) ABSTRACT

A molded plastic container having an open top and an outwardly smooth sidewall wherein the interior surface of the sidewall is characterized by a plurality of parallel vertical flutes defined by shallow, smooth concavities joined by flat columns of uniform thickness wherein the ratio of the circumferential diameter of each concavity to the circumferential width of a column is about 8:1. The outside surface of the container is smooth and molded with two integral, vertically spaced, circumferential rings for added hoop strength. The container exhibits a high stacking strength-to-weight ratio. The preferred material is HDPE.

9 Claims, 3 Drawing Sheets

(56) References Cited

U.S. PATENT DOCUMENTS

| | | | | |
|---|---|---|---|---|
| 2010/0108556 | A1* | 5/2010 | Claffy | B65D 11/24 206/508 |
| 2010/0264202 | A1* | 10/2010 | Littlejohn | B31B 43/00 229/406 |
| 2012/0018429 | A1 | 1/2012 | Claffy | |
| 2013/0075356 | A1 | 3/2013 | Bergida et al. | |

* cited by examiner

PLASTIC CONTAINER WITH FLUTED INNER WALL

FIELD OF THE INVENTION

The disclosed device lies is the field of molded plastic containers typically used to ship and store bulk products.

BACKGROUND OF THE INVENTION

Molded plastic containers are used to ship and store a wide variety of bulk products such as food, wallpaper paste and driveway sealant as examples. Such containers must withstand rough handling, a wide temperature range and stacking while filled. For 5 and 6 gallon containers, the required stacking tolerance may be as high as 3000 lbs. The preferred material for the containers is high-density polyethylene (HDPE) and the preferred configuration is tapered to allow nesting of empty containers.

SUMMARY OF THE INVENTION

Disclosed herein is an improved plastic container for shipping and storing various goods which meets the requirements set forth above while at the same time reducing weight by reducing the amount of plastic material used in the fabrication of the container. In general, this is achieved by injection molding the container such that the sidewall exhibits a smooth, cylindrical outer surface and a vertically fluted interior surface wherein the flutes are characterized by regularly spaced, smooth concavities interspersed with columns of full wall thickness. In a preferred embodiment, the flutes taper at the top so that the columns flare outwardly and join one another in a seal area. The ratio of the width of a concavity or flute at the widest point to the width of a column at the narrowest point is on the order of 8:1. The concavities lighten the container by eliminating material while the columns provide the necessary stacking strength. The smooth outer surface of the container provides a conventional appearance and label compatibility favored by users. The preferred container is molded so as to have one or more circumferential outer rings providing hoop strength.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying photographs, the latter being briefly described hereinafter.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
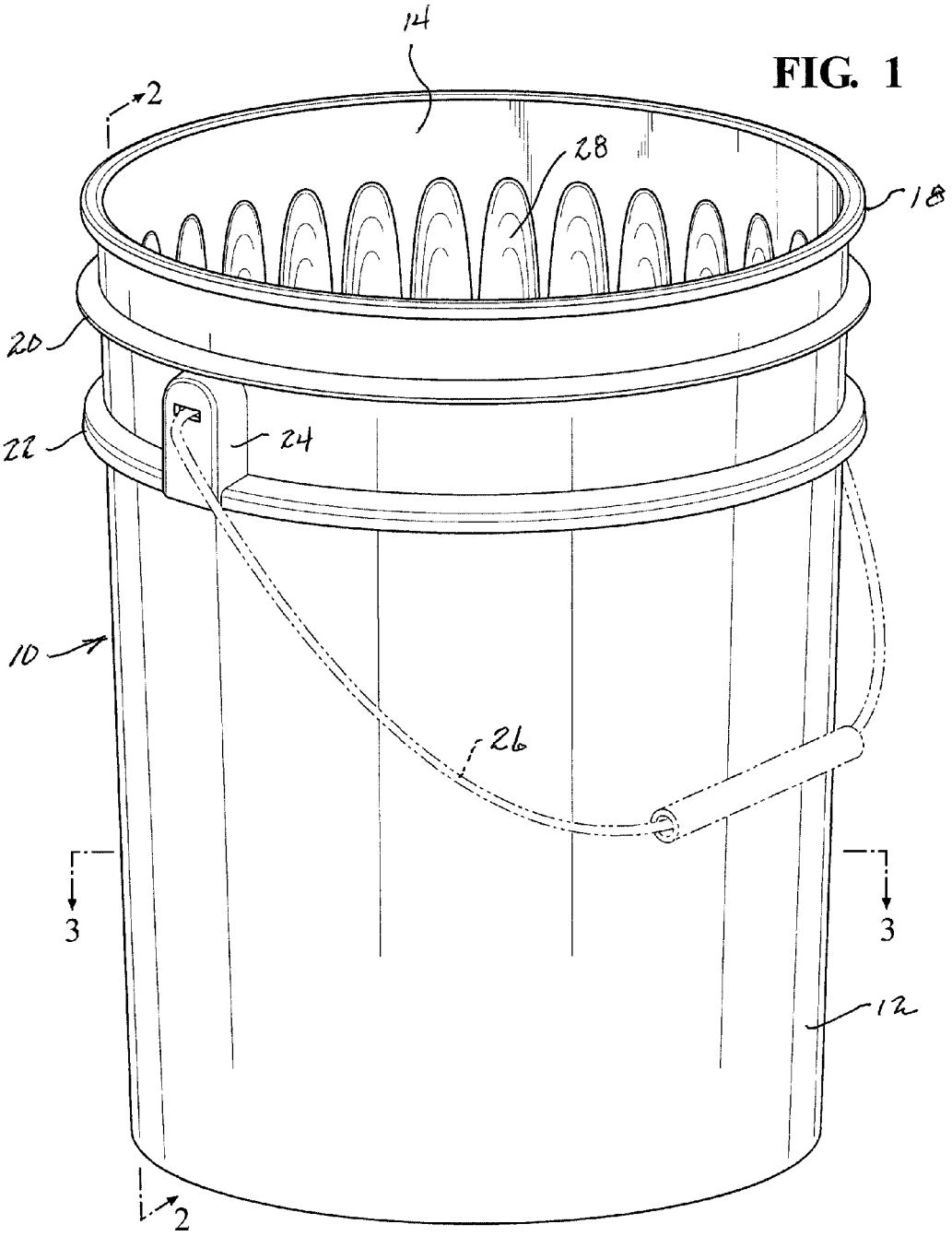
FIG. 1 is a perspective view of a molded plastic container constructed in accordance with the description given above wherein the lid has been removed to show the general configuration of the exterior and interior surfaces of the container.
Figure 2:
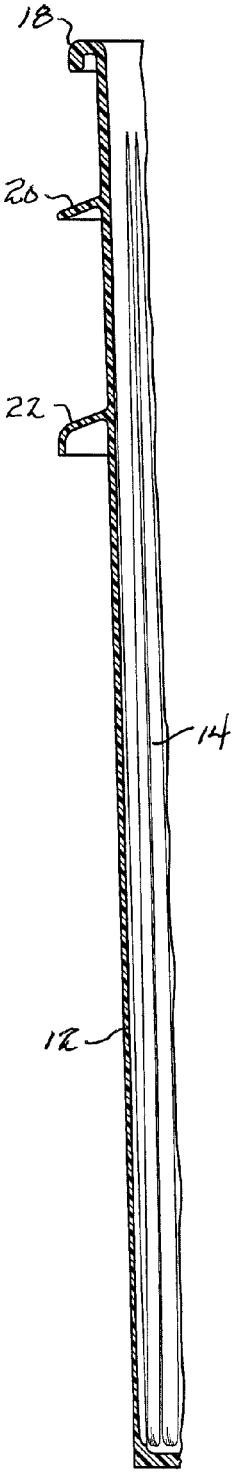
FIG. 2 is a sectional view of the container sidewall along section line 2-2.
Figure 3:
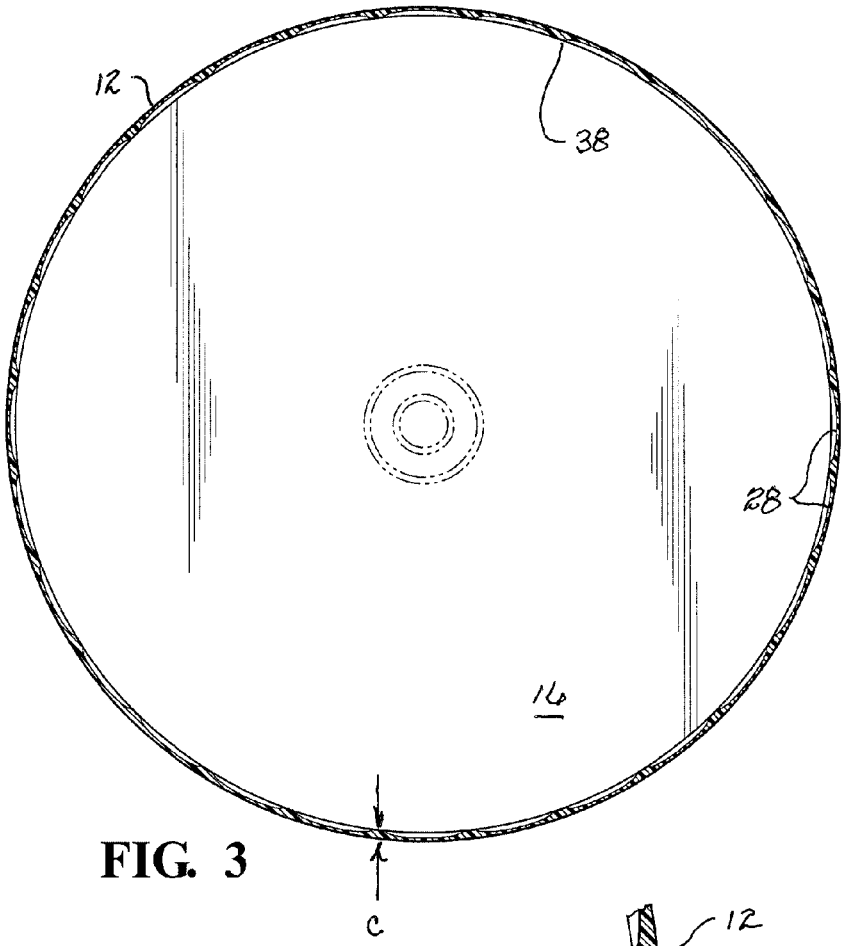
FIG. 3 is a sectional view transversely through the sidewall showing the characters of the flutes and ribs essentially at the center of the container along the section line 3-3 in FIG. 1.

Referring to the figures, there is shown an injection molded five-gallon plastic container 10 comprising a tapered cylindrical sidewall having a smooth continuous outer surface 12 and a fluted inside surface 14 integral with a planar bottom 16. The container 10 has an open top characterized by an outwardly extending lip 18 which is configured to sealingly receive a closure (not shown) also of injection molded plastic. The preferred material of construction 10 and the closure is high-density polyethylene (HDPE).

Rings 20, 22 are molded integrally with and on the outer sidewall surface 12 near the lip 18 to provide hoop strength. The bottom ring 22 limits the extent to which the tapered containers 10 may be nested within one another when stored in the empty condition. Ring 22 may be molded integrally with a pair of diagonally opposite bail ears 24 which receive a wire bail 26 of conventional design for the purpose of carrying the container, usually in the filled or partially filled condition.

Figure 4:
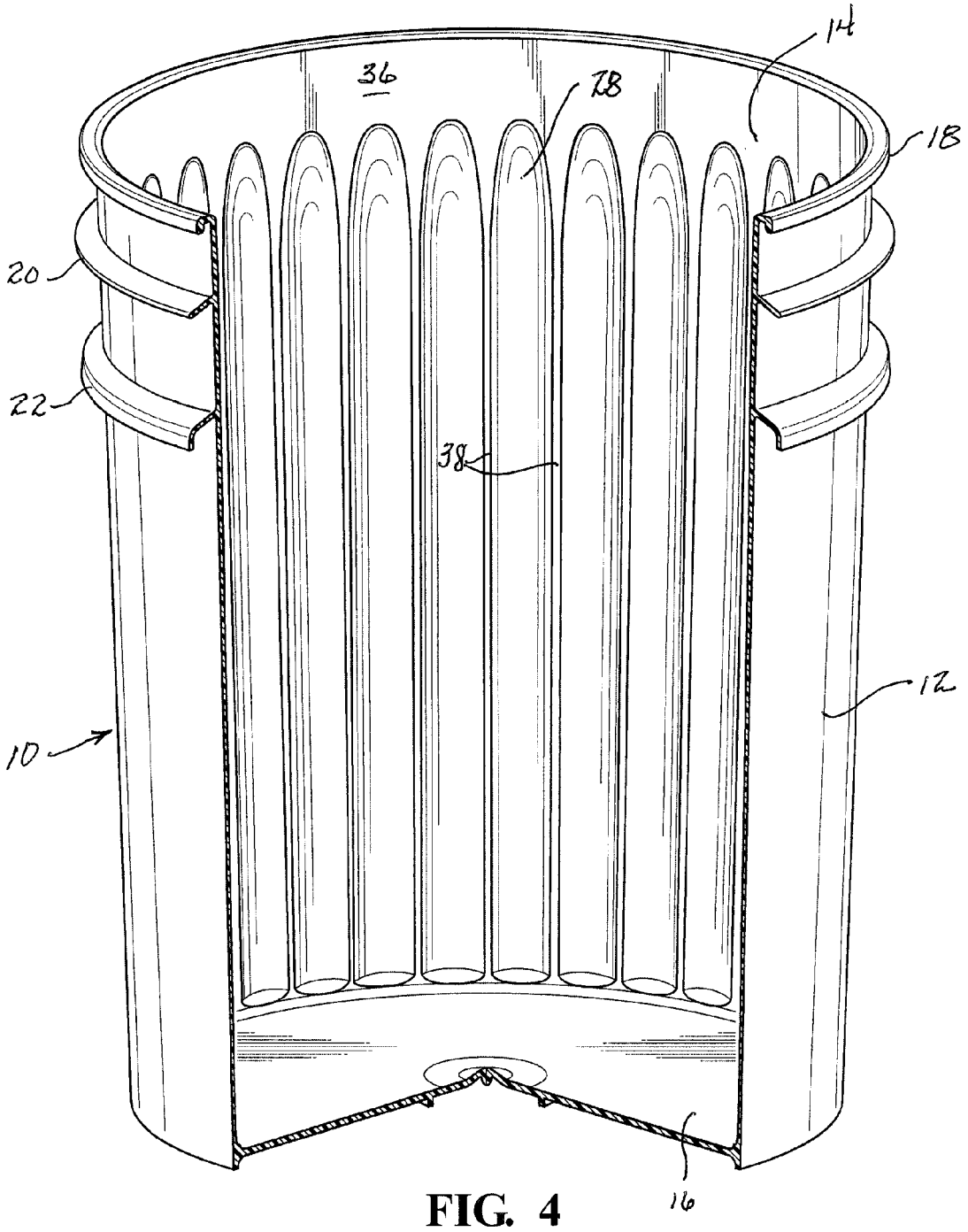
FIG. 4 is a perspective view of the container of FIG. 1 with part of the sidewall cut away.

The inside surface 14 has formed therein a regularly spaced series of vertical flutes 28 which are spaced apart by columns 38. The columns 38 as well as the top band 36 above the flutes 28 and extending up to the flanged lip 18 are all of a uniform thickness which, in the illustrative embodiment, is 0.092 inches. It will be understood that this dimension is for illustrative and discussion purposes only and may vary according to the desired strength of the container 10 as well as its overall size. The concavities 28 are circumferentially smooth and progress with regular curvature from the maximum thickness of 0.092 inches at the lateral edges to a minimum center thickness of 0.070 inches, again, this dimension is given by way of illustration. Accordingly, the depth of each concavity is on the order of 0.022 inches at the center. The tops of the concavities are tapered as best shown in FIGS. 1 and 4 so that the columns flare out at the tops of the flutes. The flutes 28 are essentially flat at the bottoms and extend substantially all the way to the bottom 16, although a small ledge may be used as shown.

In the example given, the circumferential width a of each flute from edge to edge is approximately 1 inch while the width b of the columns 38 at minimum (i.e., at the vertical center thereof) is approximately ⅛ inch. Accordingly, the ratio of the maximum flute width to the minimum column width is about 8:1 and we have found this to be an optimum ratio for a five-gallon HDPE container with a required stacking strength of approximately 3,000 lbs. However, a range of about 5:1 to 10:1 is possible. The tops of the columns 38 flare out and blend seamlessly into the seal band 36 at the top of the container sidewall. This helps direct vertical loads into the volume and eliminates stress concentration points that abrupt corners would create. A five-gallon pail with a diameter of about 11" will exhibit twenty-eight flutes and this has been found to create a container of light weight and good stacking strength. The number of flutes for an 11" diameter pail can vary from about twenty-four to about thirty-two.

Figure 5:
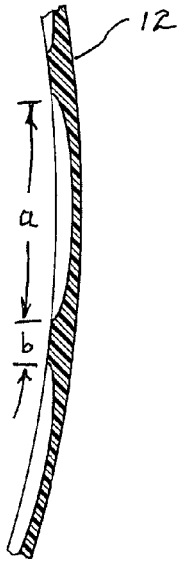
FIG. 5 is a detailed view of part of the interior sidewall surface showing certain dimensional relationships.

In FIG. 5, the dimension a represents the maximum width of the flute 28 while the dimension b represents the width of a column 38 and the dimension c is the nominal sidewall thickness. As indicated above, the ratio of a:b is approximately 6:1 but may vary according to container size. The flutes 28 and columns 38 provide an interesting and pleasing appearance to the container 10 and result in a significant reduction in the amount of HDPE required to manufacture the container 10 through the injection molding process. This contributes to a substantial weight reduction and an increase in the stacking-strength-to-weight ratio.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An open-top injection molded plastic container comprising:

a continuous circular sidewall having inside and outside surfaces;

a bottom integral with said sidewall;

wherein the sidewall has formed on the inside surface thereof a plurality of circumferentially spaced concave vertical flutes having vertical edges of a first maximum wall thickness; said concave flutes having centers of a second minimum wall thickness substantially less than said maximum thickness wherein between the flutes are vertical, essentially flat-surfaced columns of a constant thickness equal to said maximum wall thickness and wherein the columns and flutes extend vertically for more than 50% of the height of the sidewall;

the outside surface is smooth and unfluted; and wherein the center depth of the concavity is about 0.022 inches and the thickness of the sidewall is about 0.070 inches at the center of a concavity and about 0.092 inches at the center of a flat-surfaced column.

2. A molded plastic container as defined in claim 1 wherein the ratio of the circumferential width of each concavity to the circumferential width of a flat-surfaced column is between 5:1 to 10:1.

3. A molded plastic container as defined in claim 1 wherein the capacity of the container is at least 5 gallons.

4. A molded plastic container as defined in claim 1 wherein outside surface of the sidewall has integrally molded therewith at least one circumferential ring which is closer to the top than to the bottom.

5. A molded plastic container as defined in claim 1 wherein the outside surface of the sidewall has integrally molded therein a pair of circumferential rings, at least one of said rings being intercepted by a pair of diametrically opposite bail ears.

6. A molded plastic container as defined in claim 1 wherein the flutes taper at the tops and blend into an internally smooth annular seal band proximate the open top of the container and of uniform thickness around the circumference thereof.

7. A molded plastic container as defined in claim 6 wherein the flutes have flat bottoms proximate the bottom of the container.

8. A molded plastic container as defined in claim 1 wherein the material of construction is HDPE.

9. A five-gallon molded plastic container comprising:

a continuous circular sidewall having a smooth cylindrical outer surface and a vertically fluted inner surface formed by between twenty-five and thirty-two shallow, concave vertical flutes interspersed with flat-surfaced vertical columns of about ⅛ to ¼ inch in width and wherein the columns are of uniform wall thickness in the range of about of about 0.090 to 0.092 inches and the flutes have a minimum wall thickness of about 0.070 inches and wherein the columns flare outwardly into a circumferential seal band proximate the top of the sidewall and having a uniform wall thickness of the same thickness as the columns.

* * * * *